US008641078B2

(12) United States Patent
Yang

(10) Patent No.: US 8,641,078 B2
(45) Date of Patent: Feb. 4, 2014

(54) FOLDABLE WHEELCHAIR

(76) Inventor: Po Hsuan Yang, Tainan (TW)

( * ) Notice: Subject to any disclaimer, the term of this patent is extended or adjusted under 35 U.S.C. 154(b) by 151 days.

(21) Appl. No.: 13/295,232

(22) Filed: Nov. 14, 2011

(65) Prior Publication Data

US 2013/0119642 A1 May 16, 2013

(51) Int. Cl.
*A61G 5/08* (2006.01)

(52) U.S. Cl.
CPC ..... *A61G 5/08* (2013.01)
USPC ..... 280/647

(58) Field of Classification Search
CPC ..... B60G 9/022; B60G 2206/604; B60G 2204/4306
USPC ..... 280/647, 250.1; 403/374.5, 341, 292, 403/293, 322.4, 349
See application file for complete search history.

(56) References Cited

U.S. PATENT DOCUMENTS

2005/0077760 A1* 4/2005 Smith ..... 297/42
2007/0232155 A1* 10/2007 Frey ..... 439/783
2008/0036261 A1* 2/2008 Yang ..... 297/354.11
2008/0265542 A1* 10/2008 Chong ..... 280/250.1
2009/0194974 A1* 8/2009 Smith ..... 280/647

* cited by examiner

*Primary Examiner* — John R Olszewski
*Assistant Examiner* — Brian Cassidy
(74) *Attorney, Agent, or Firm* — Rosenberg, Klein & Lee

(57) ABSTRACT

A foldable wheelchair comprises a body, a first support rod, a second support rod, a backrest rack and a connecting unit. The backrest rack is provided with a first support tube swingably disposed on the first support rod and a second support tube swingably disposed on the second support rod. The first and second support tubes can be separated from each other and swing outwardly by the connecting unit, which facilitates the folding operation of the wheelchair, such a wheelchair is small and is convenient to carry.

3 Claims, 11 Drawing Sheets

FOLDABLE WHEELCHAIR

BACKGROUND OF THE INVENTION

1. Field of the Invention

The present invention relates to a wheelchair, and more particularly to a foldable wheelchair which can be reduced in size after being folded.

2. Description of the Prior Art

Conventional wheelchair backrest is mainly made of flexible canvas for bringing better user comfort, however, when the user sits on the wheelchair and his/her back rests against the backrest, the backrest made of flexible canvas can not support the back of the user stably, which causes a deflective sitting posture, thus resulting in curvature of the spine over a long period of time and seriously affecting the health of the user.

An improved wheelchair is disclosed in Republic of China Patent No. M404007 and Germany Patent No. 202011101831.1, wherein the wheelchair comprises a backrest unit having an outer tube and at least one backrest connected to the outer tube. When the user sits on the wheelchair, the backrest can stably support his/her back, so as to make the user keep a correct posture. However, the setting of the outer tube makes the wheelchair unfoldable, therefore, such a wheelchair is large and inconvenient to carry.

The present invention has arisen to mitigate and/or obviate the afore-described disadvantages.

SUMMARY OF THE INVENTION

The primary objective of the present invention is to provide a foldable wheelchair which comprises a body, a first support rod, a second support rod, a backrest rack and a connecting unit.

The body is provided with a seat portion.

The first support rod is disposed at a back side of the seat portion.

The second support rod is disposed at the back side of the seat portion and is located opposite the first support rod.

The backrest rack is provided with a first support tube swingably disposed on the first support rod, a second support tube swingably disposed on the second support rod, and two backrests connected to the first and second support tubes, respectively. A free end of the first support tube is defined with an elongated through hole.

The connecting unit is provided with an inner pipe mounted on an inner peripheral surface of the free end of the first support tube and an inner peripheral surface of a free end of the second support tube, an outer pipe mounted on an outer peripheral surface of the free end of the first support tube and an outer peripheral surface of the free end of the second support tube, and a pulling member. The inner pipe is defined with a threaded hole. The outer pipe is defined with a penetrating hole. The pulling member comprises a pivoting portion, a pulling portion disposed reverse to the pivoting portion and a screw pivoted to the pivoting portion. The screw is firstly passed through the penetrating hole of the outer pip and the elongated through hole of the first support tube, and then is threaded in the threaded hole of the inner pipe, such that the first and second support tubes can be clamped between the inner pipe and the outer pipe.

The first and second support tubes can be separated from each other and swing outwardly by the connecting unit, which facilitates the folding operation of the wheelchair, such a wheelchair is small and is convenient to carry.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
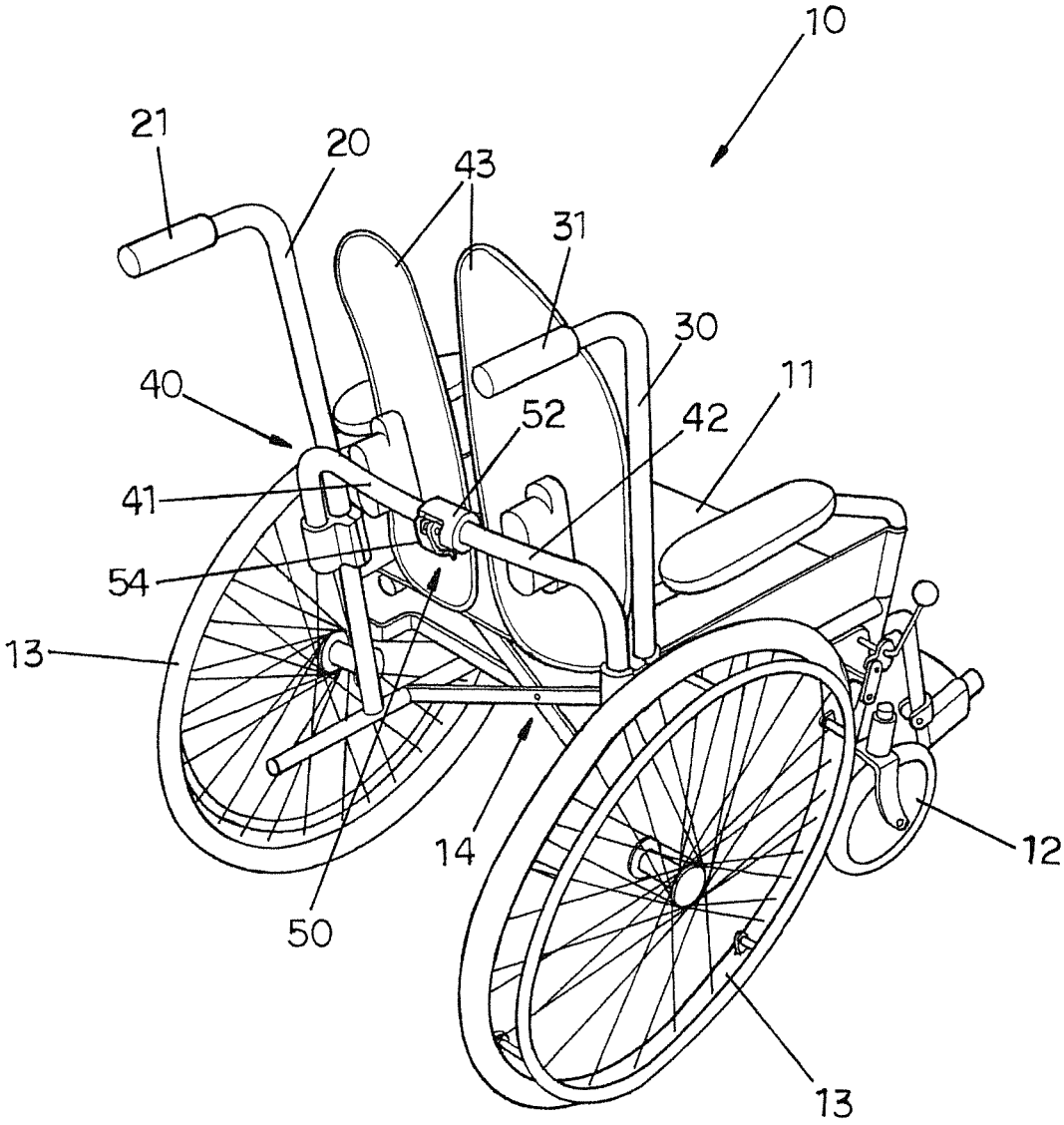
FIG. 1 is a perspective view of a foldable wheelchair in accordance with the present invention.
Figure 2:
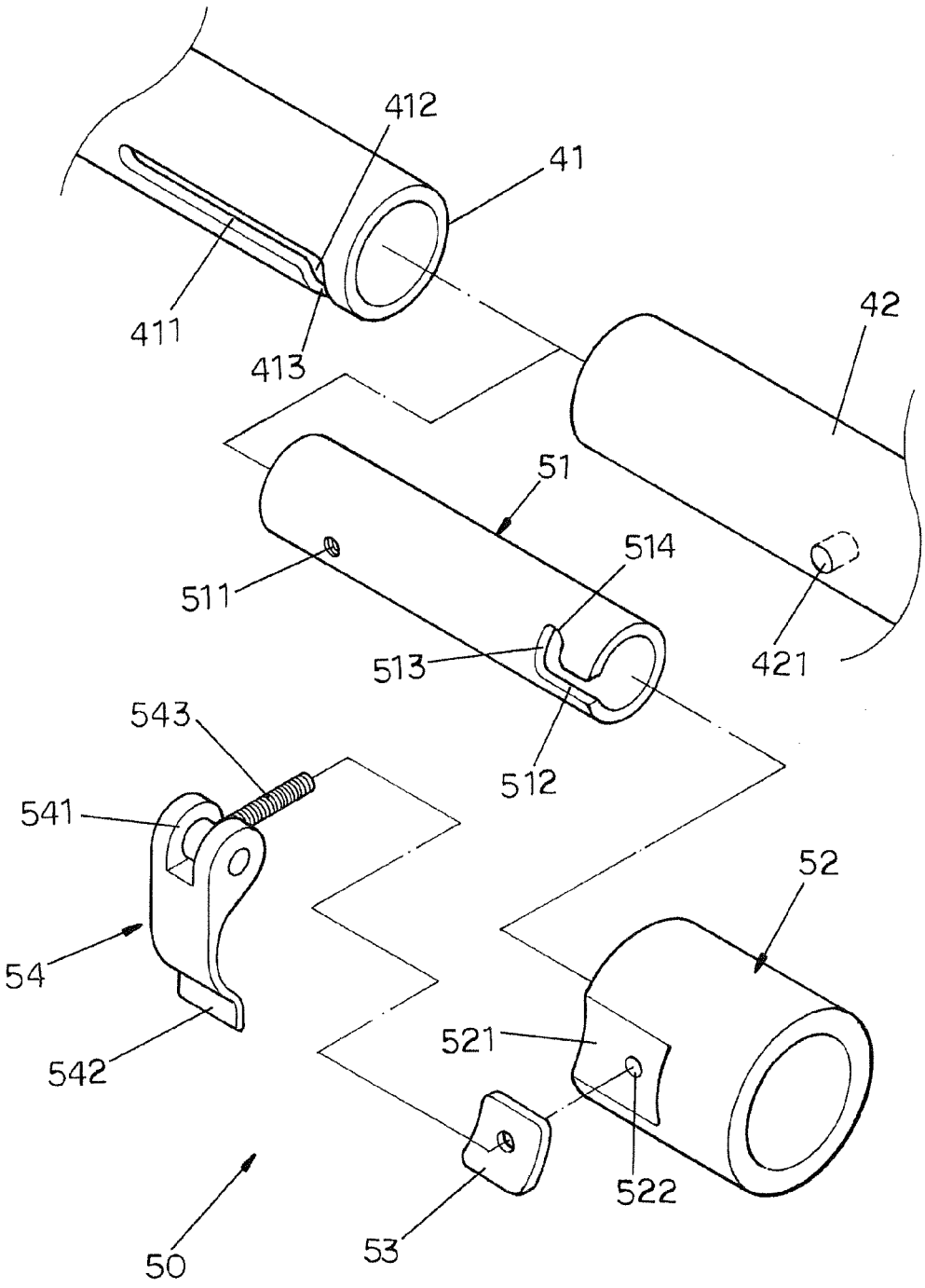
FIG. 2 is an exploded view of partial components of the foldable wheelchair in accordance with the present invention, wherein the relative positions of a first support tube, a second support tube and a connecting unit are shown.
Figure 3:
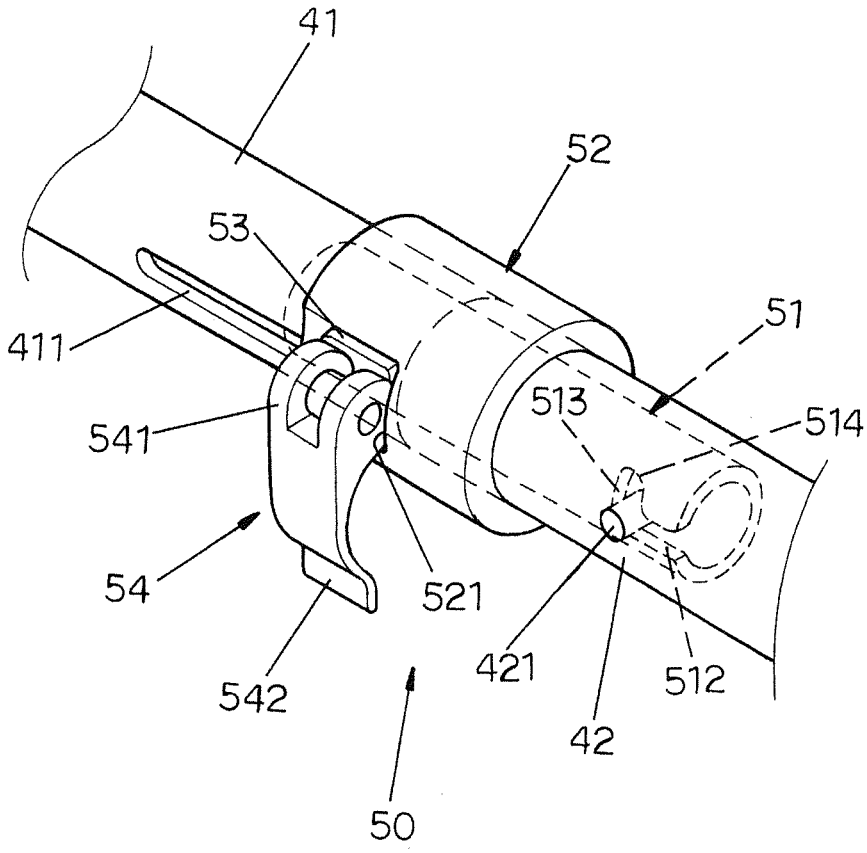
FIG. 3 is an assembly perspective view of FIG. 2.
Figure 4:
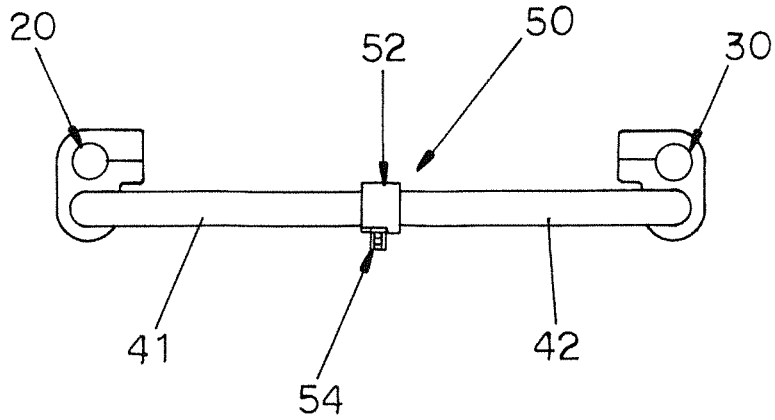
FIG. 4 is an assembly plan view of partial components of the foldable wheelchair in accordance with the present invention, wherein the first support tube is connected to the second support tube by the connecting unit.

Referring to FIGS. 1-3, a foldable wheelchair in accordance with the present invention comprises a body 10, a first support rod 20, a second support rod 30, a backrest rack 40 and a connecting unit 50.

The body 10 is provided with a flexible seat portion 11, two front wheels 12 disposed below the seat portion 11, two rear wheels 13 disposed at both lateral sides of the seat portion 11 and a linkaging unit 14 for folding or unfolding the wheelchair.

The first support rod 20 is disposed at a back side of the seat portion 11, and a top end of the first support rod 20 is bended to form a first handle 21.

The second support rod 30 is disposed at the back side of the seat portion 11 and is located opposite the first support rod 20, and a top end of the second support rod 30 is bended to form a second handle 31.

The backrest rack 40 is provided with a first support tube 41 swingably disposed on the first support rod 20, a second support tube 42 swingably disposed on the second support rod 30, and two backrests 43 connected to the first and second support tubes 41, 42, respectively. A free end of the first support tube 41 is defined with an elongated through hole 411.

The connecting unit 50 is provided with an inner pipe 51 mounted on an inner peripheral surface of the free end of the first support tube 41, an outer pipe 52 mounted on an outer peripheral surface of the free end of the first support tube 41, a pad 53 and a pulling member 54.

The inner pipe 51 is defined with a threaded hole 511.

The outer pipe 52 is defined with an arc-shaped concave portion 521 and a penetrating hole 522 penetrating the arc-shaped concave portion 521.

The pad 53 is attached to the arc-shaped concave portion 521.

The pulling member 54 comprises a pivoting portion 541 attached to the pad 53, a pulling portion 542 disposed reverse to the pivoting portion 541 and a screw 543 pivoted to the pivoting portion 541. The screw 543 is firstly passed through the pad 53, the penetrating hole 522 of the outer pipe 52 and the elongated through hole 411 of the first support tube 41, and then is threaded in the threaded hole 511 of the inner pipe 51.

Figure 8:
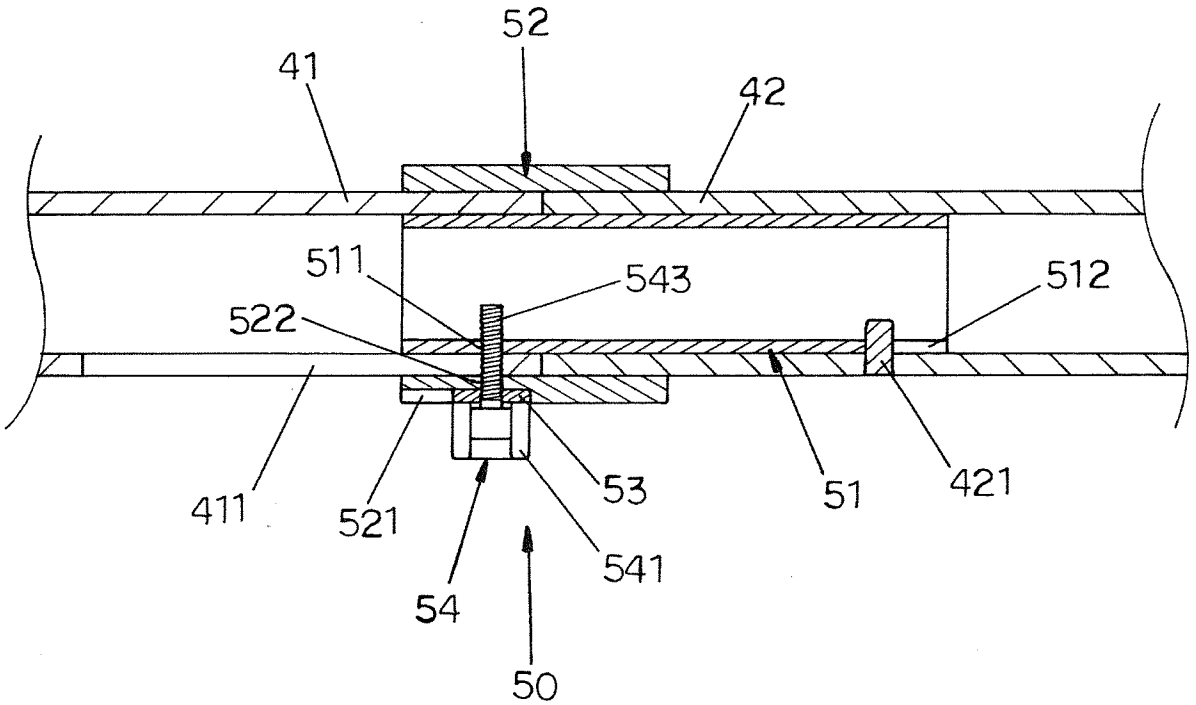
FIG. 8 is another assembly cross sectional view of partial components of the foldable wheelchair in accordance with the present invention, wherein the inner and outer pipes are mounted on free ends of the first and second support tubes, respectively.

Referring to FIGS. 4-6 and 8, when in use, the user firstly operates the linkaging unit 14 to make the wheelchair unfolded (as shown in FIG. 1), and swings the first and second support tubes 41, 42 inwardly so as to make their free ends connect and align with each other and to make the backrests 43 locate between the first support rod 20 and the second support rod 30. And then, the user makes the screw 543 move in the elongated through hole 411 so as to move the connecting unit 50, such that the inner pipe 51 will be mounted on the inner peripheral surface of the free end of the first support tube 41 and an inner peripheral surface of the free end of the second support tube 42, and the outer pipe 52 will be mounted on the outer peripheral surface of the free end of the first support tube 41 and an outer peripheral surface of the free end of the second support tube 42 (as shown in FIG. 8). Finally, the user pulls the pulling portion 542 to make it near the outer pipe 52, so that the screw 543 will move the inner pipe 51 towards the pulling member 54, so as to press against the first and second support tubes 41, 42, thus pressing against the outer pipe 52 by the first and second support tubes 41, 42. At that time, the first and second support tubes 41, 42 can be clamped between the inner pipe 51 and the outer pipe 52 stably, thus maintaining the wheelchair in the suitable position for the user's back to rest against.

Figure 5:
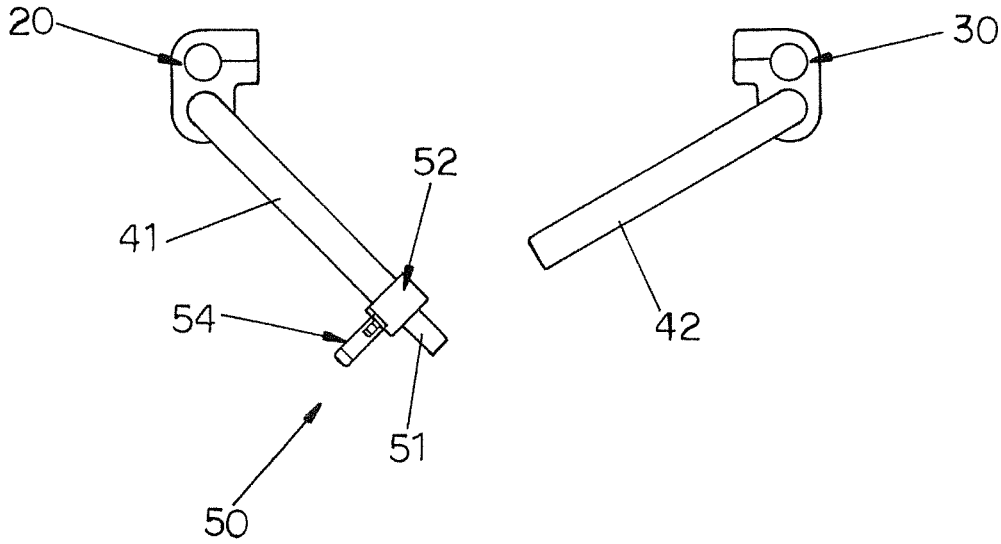
FIG. 5 is another assembly plan view of partial components of the foldable wheelchair in accordance with the present invention, wherein the first and second support tubes are separated from each other and swing outwardly.
Figure 6:
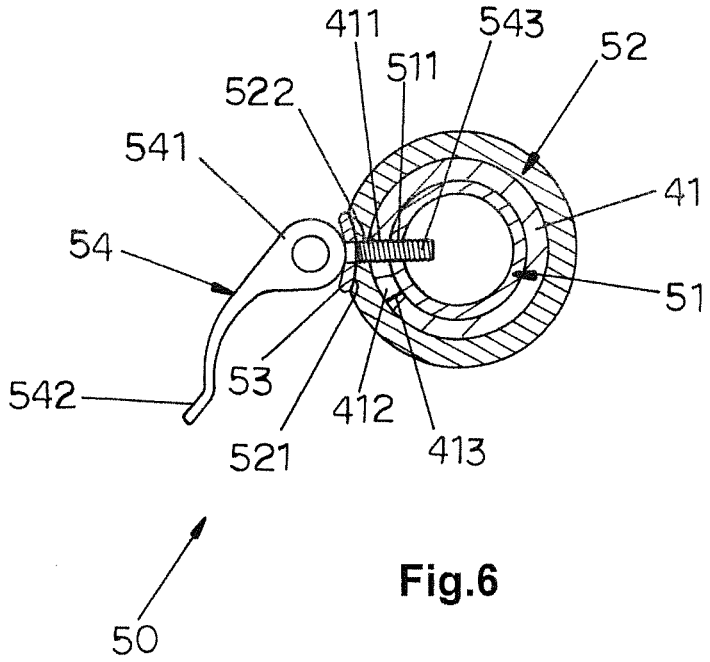
FIG. 6 is an assembly cross sectional view of partial components of the foldable wheelchair in accordance with the present invention, wherein a pulling portion is separated from an outer pipe and a screw is located in an elongated through hole.
Figure 7:
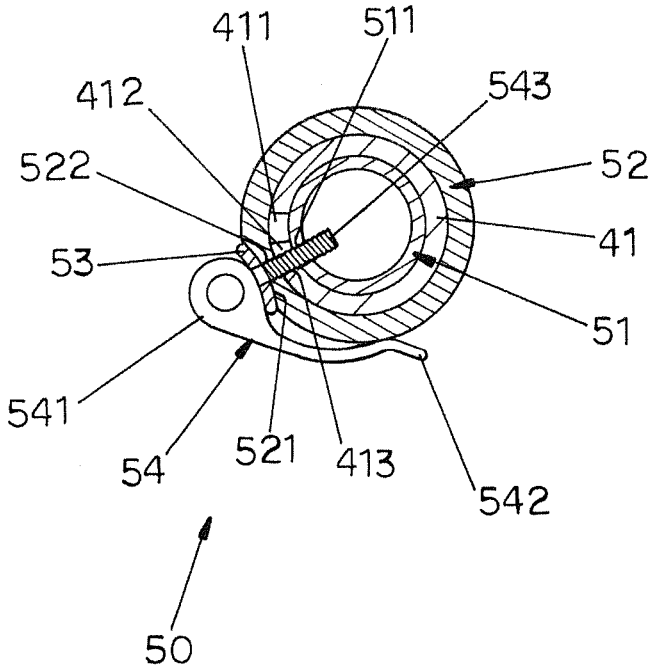
FIG. 7 is another assembly cross sectional view of partial components of the foldable wheelchair in accordance with the present invention, wherein the pulling portion is attached to the outer pipe and the screw is abutted against a stop end.
Figure 9:
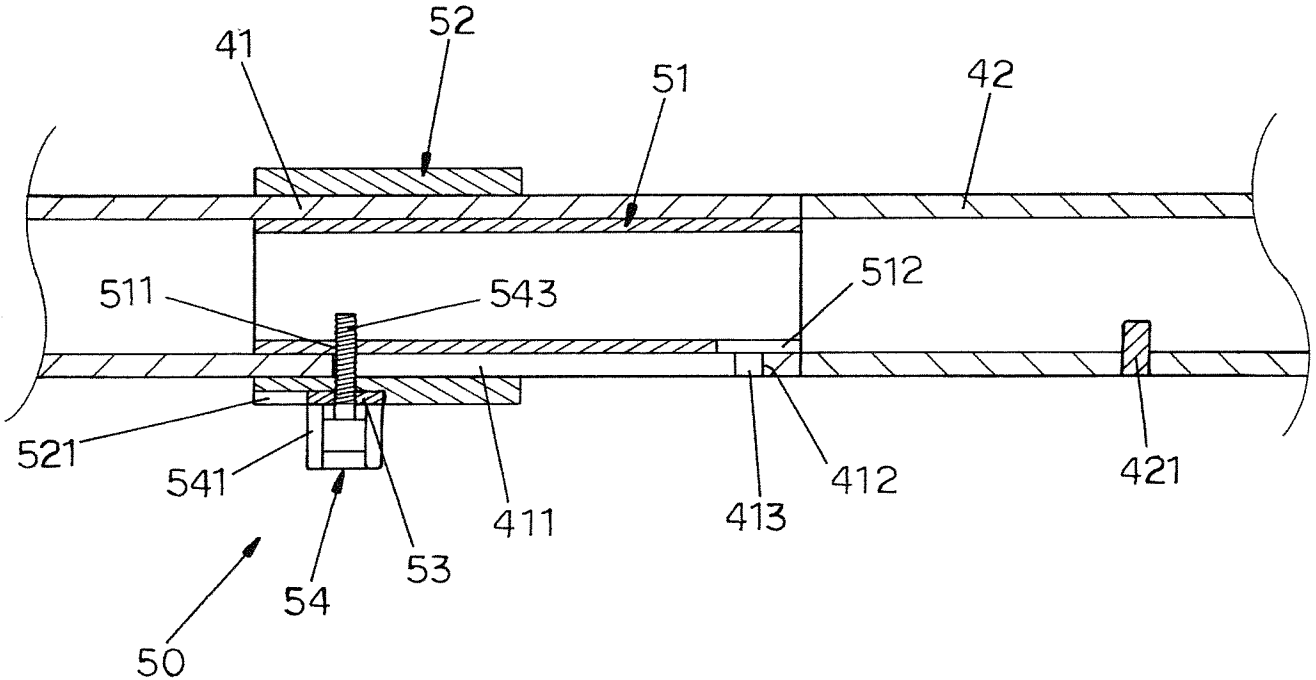
FIG. 9 is another assembly cross sectional view of partial components of the foldable wheelchair in accordance with the present invention, wherein the connecting unit is separated from the free end of the second support tube.
Figure 10:
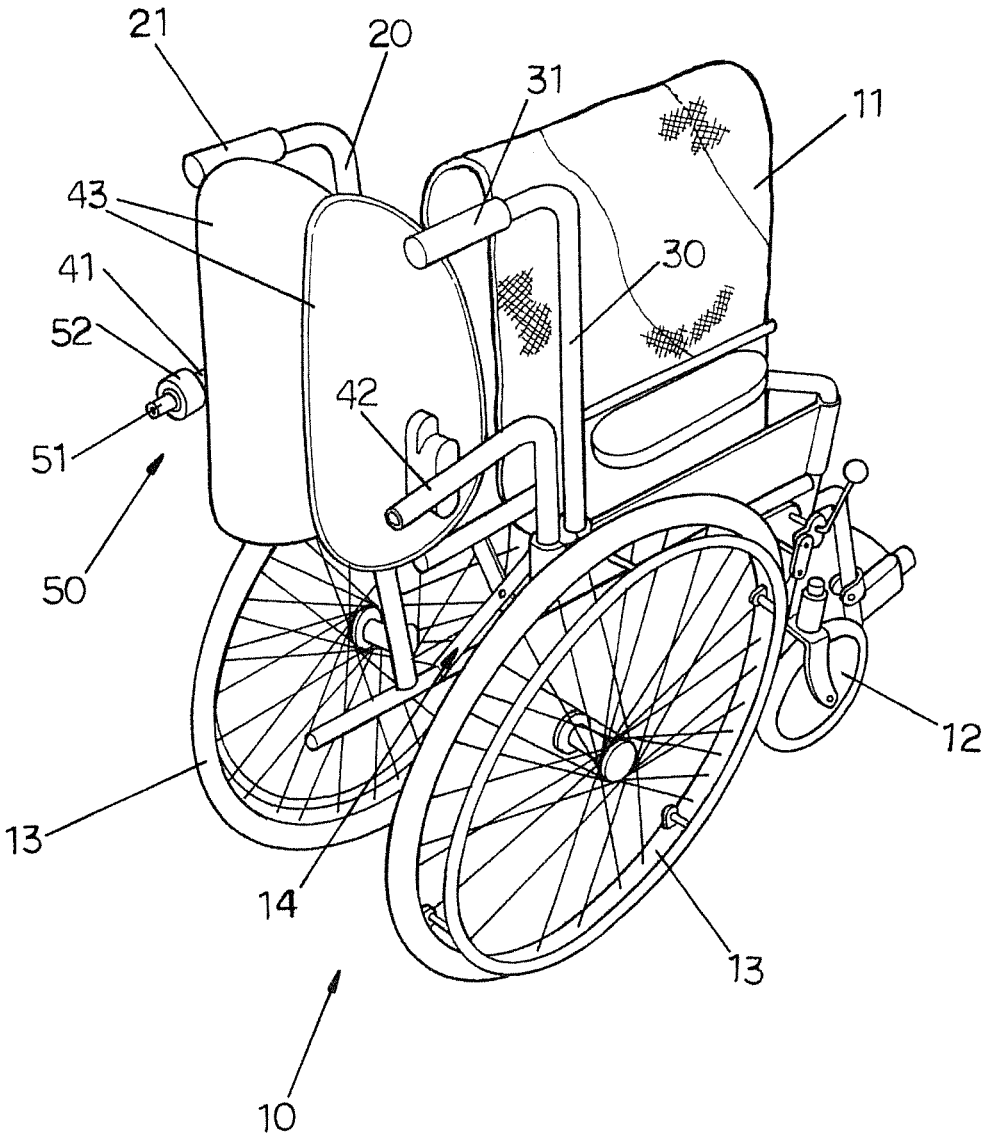
FIG. 10 is a perspective view showing the foldable wheelchair in accordance with the present invention after being folded.
Figure 11:
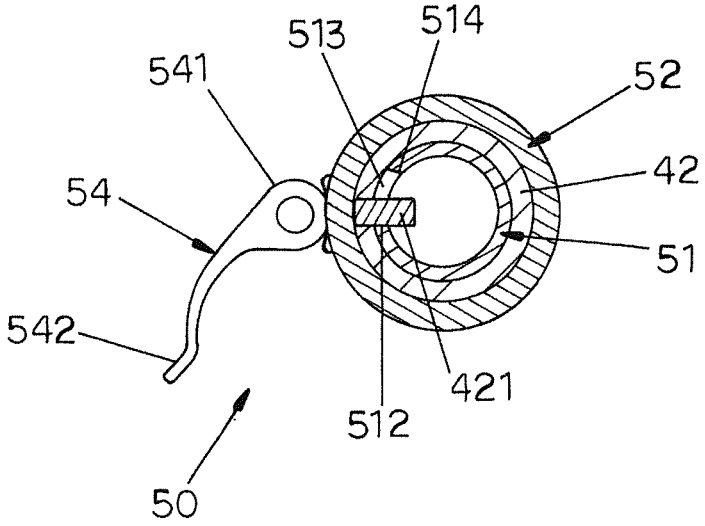
FIG. 11 is another assembly cross sectional view of partial components of the foldable wheelchair in accordance with the present invention, wherein a positioning post is located at a joint of a long horizontal hole and a long straight hole.
Figure 12:
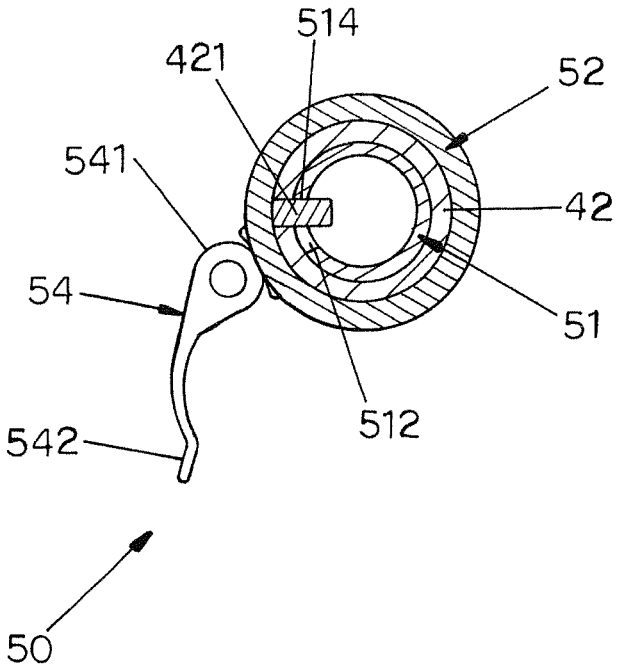
FIG. 12 is another assembly cross sectional view of partial components of the foldable wheelchair in accordance with the present invention, wherein a positioning end is abutted against the positioning post after pivoting an angle of the connecting unit downwardly.
Figure 13:
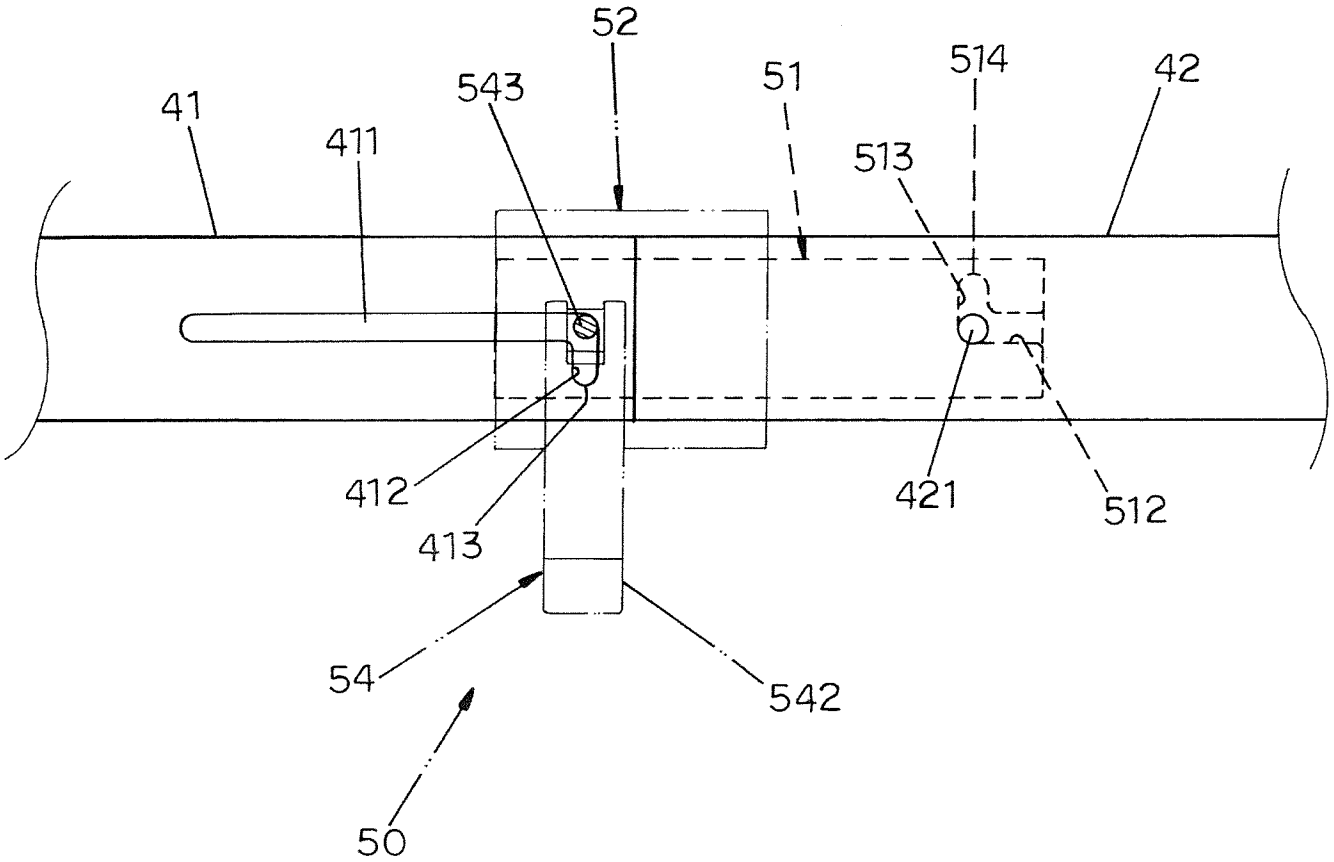
FIG. 13 is another assembly plan view of partial components of the foldable wheelchair in accordance with the present invention, wherein the screw is located at a joint of the elongated through hole and an elongated guiding hole, and the positioning post is located at the joint of the long horizontal hole and the long straight hole.
Figure 14:
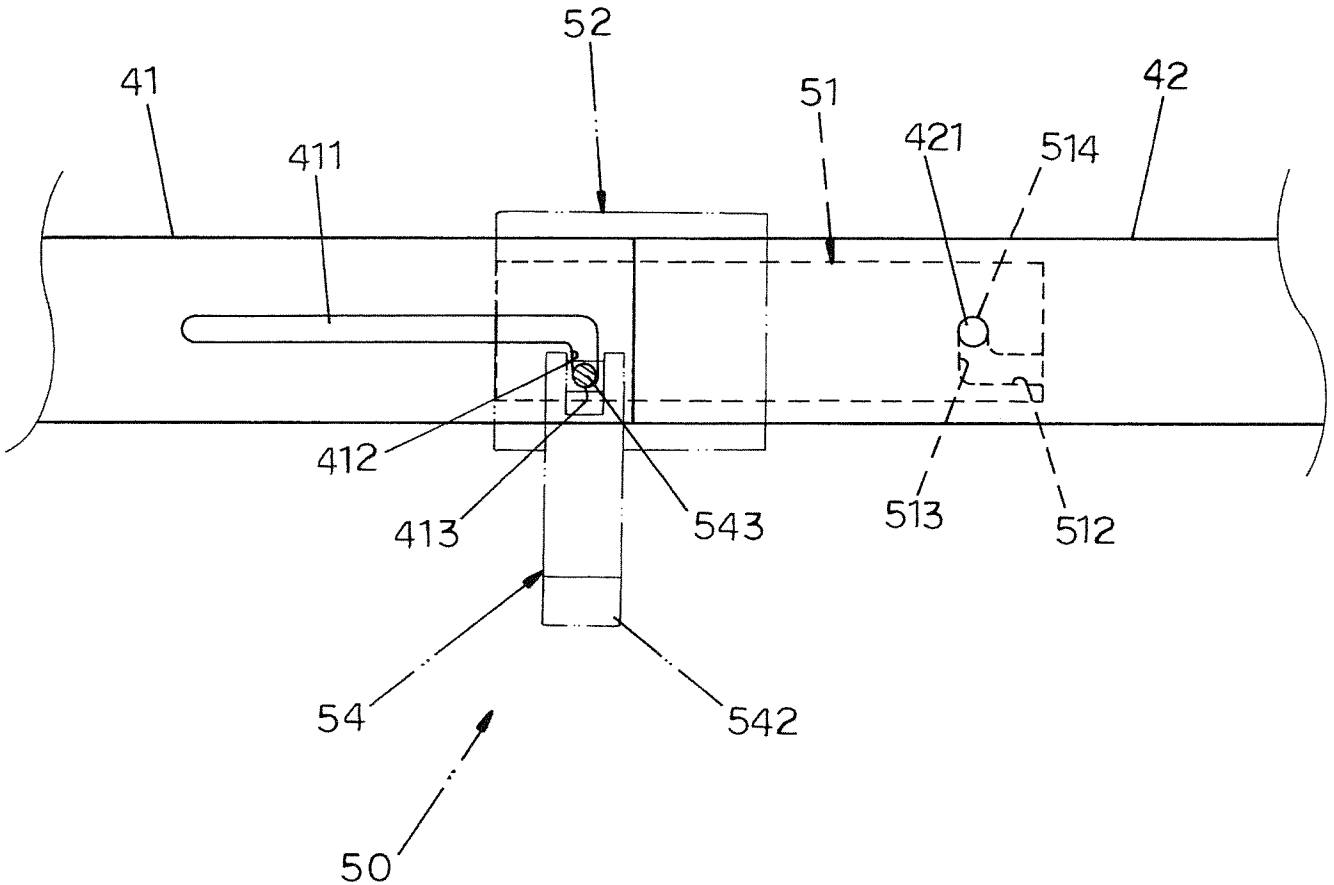
FIG. 14 is another assembly plan view of partial components of the foldable wheelchair in accordance with the present invention, wherein after pivoting an angle of the connecting unit downwardly, the screw is stopped by the stop end and the positioning end is abutted against the positioning post.

Referring to FIGS. 7, 9 and 10, the folding operation of the wheelchair is shown, the user pulls the pulling portion 542 to make it separate from the outer pipe 52, such that the screw 543 will pull the inner pipe 51 and make it move in a reverse direction of the pulling member 54, so as to release the inner and outer pipes 51, 52 from the first and second support tubes 41, 42. In addition, by the movement of the screw 543 in the elongated through hole 411, the connecting unit 50 will be separated from the free end of the second support tube 42 (as shown in FIG. 9) and located in the free end of the first support tube 41. At that time, the first support tube 41 will be separated from the second support tube 42, that is, the first and second support tubes 41, 42 swing outwardly (as shown in FIG. 5). Then, the user pulls the seat portion 11 upwardly to drive the linkaging unit 14 to fold the wheelchair successfully and quickly (as shown in FIG. 10).

Referring to FIGS. 2 and 3, in order to increase the firmness of the connecting unit 50 when being mounted on the first and second support tubes 41, 42, the wheelchair is further provided with a stop device having an elongated guiding hole 412 defined in the first support tube 41 and vertically connected to the elongated through hole 411, a long horizontal hole 512 defined in a free end of the inner pipe 51 and in communication with outside, a long straight hole 513 defined in the inner pipe 51 and vertically connected to the long horizontal hole 512, and a positioning post 421 fixed to and protruded out of the second support tube 42. A bottom end of the elongated guiding hole 412 is defined to be a stop end 413, and a top end of the long straight hole 513 is defined to be a positioning end 514.

Referring to FIGS. 11-14, when in use, after the first support tube 41 is connected to the second support tube 42, the user moves the connecting unit 50 to make the screw 543 move to a joint of the elongated through hole 411 and the elongated guiding hole 412 and mount the inner pipe 51 on the inner peripheral surface of the free end of the second support tube 42, such that the long horizontal hole 512 will move along the positioning post 421 and the positioning post 421 is located at a joint of the long horizontal hole 512 and the long straight hole 513. And then, the user pivots an angle of the connecting unit 50 downwardly, such that the long straight hole 513 will move along the positioning post 421 and the positioning end 514 will be abutted against the positioning post 421, and the screw 543 will move in the elongated guiding hole 412 and will be stopped by the stop end 413. Finally, the user pulls the pulling portion 542 to make it near the outer pipe 52, such that the first and second support tubes 41, 42 will be clamped between the inner pipe 51 and the outer pipe 52 firmly by the stop device, the stop device can firmly secure the connecting unit 50, the first and second support tubes 41, 42, thus finishing the unfolding operation of the wheelchair. The folding operation of the wheelchair can be finished by performing the above-mentioned steps reversely.

To conclude, the foldable wheelchair of the present invention is characterized in that: the first and second support tubes 41, 42 of the backrest rack 40 can be separated from each other and swing outwardly by the connecting unit 50, which facilitates the folding operation of the wheelchair, such a wheelchair is small and is convenient to carry. Moreover, the connecting unit 50 can be mounted on the first and second support tubes 41, 42 firmly by the stop device, which increases the firmness of the backrests 43, such that the user's back can rest against the backrests 43 stably, thus preventing his/her spine from being curved.

While we have shown and described various embodiments in accordance with the present invention, it should be clear to those skilled in the art that further embodiments may be made without departing from the scope of the present invention.

What is claimed is:

1. A foldable wheelchair comprising:

a body having a seat portion;

a first support rod being disposed at a back side of the seat portion;

a second support rod being disposed at the back side of the seat portion and located opposite the first support rod;

a backrest rack being provided with a first support tube swingably disposed on the first support rod, a second support tube swingably disposed on the second support rod, and two backrests connected to the first and second support tubes, respectively, a free end of the first support tube being defined with an elongated through hole;

a connecting unit being provided with an inner pipe mounted on an inner peripheral surface of the free end of the first support tube and an inner peripheral surface of a free end of the second support tube, an outer pipe mounted on an outer peripheral surface of the free end of the first support tube and an outer peripheral surface of the free end of the second support tube, and a pulling member, the inner pipe being defined with a threaded hole, the outer pipe being defined with a penetrating hole, the pulling member being provided with a pivoting portion, a pulling portion disposed reverse to the pivoting portion and a screw pivoted to the pivoting portion, the screw being firstly passed through the penetrating hole of the outer pipe and the elongated through hole of the first support tube, and then being threaded in the threaded hole of the inner pipe, such that the first and second support tubes are clamped between the inner pipe and the outer pipe; and a stop device which includes:

an elongated guiding hole defined in the first support tube and vertically connected to the elongated through hole, a bottom end of the elongated guiding hole being defined to be a stop end;

a long horizontal hole defined in a free end of the inner pipe and in communication with outside;

a long straight hole defined in the inner pipe and vertically connected to the long horizontal hole, a top end of the long straight hole being defined to be a positioning end; and a positioning post fixed to and protruded out of the second support tube;

wherein when in use, the user moves the connecting unit to make the screw move to a joint of the elongated through hole and the elongated guiding hole, such that the long horizontal hole will move along the positioning post and the positioning post is located at a joint of the long horizontal hole and the long straight hole, and then, the user pivots an angle of the connecting unit downwardly, such that the long straight hole will move along the positioning post and the positioning end will be abutted against the positioning post, and the screw will move in the elongated guiding hole and will be stopped by the stop end.

2. The foldable wheelchair as claimed in claim 1, wherein the outer pipe of the connecting unit is defined with an arc-shaped concave portion for attaching a pad, the penetrating hole penetrates the arc-shaped concave portion, and the screw is passed through the pad.

3. The foldable wheelchair as claimed in claim 1, wherein seat portion of the body is flexible.

* * * * *